US006408463B1

(12) United States Patent
Palacio

(10) Patent No.: US 6,408,463 B1
(45) Date of Patent: Jun. 25, 2002

(54) BABY PLAY MAT WITH PROTECTIVE ENCLOSURE

(76) Inventor: Andrea Palacio, 19411 Hanby Creek Ct., Houston, TX (US) 77094

( * ) Notice: Subject to any disclaimer, the term of this patent is extended or adjusted under 35 U.S.C. 154(b) by 0 days.

(21) Appl. No.: 09/665,135

(22) Filed: Sep. 19, 2000

(51) Int. Cl.[7] ..... A47D 13/06
(52) U.S. Cl. ..... 5/424; 5/655; 5/427
(58) Field of Search ..... 5/424, 425, 427, 5/417, 420, 678, 680, 732, 655, 657

(56) References Cited

U.S. PATENT DOCUMENTS

| | | | | | |
|---|---|---|---|---|---|
| 4,712,258 | A | | 12/1987 | Eves | 5/424 |
| 4,873,734 | A | * | 10/1989 | Pollard | 5/525 |
| 4,999,866 | A | * | 3/1991 | Lindsey | 5/427 |
| 5,035,013 | A | | 7/1991 | Bloom | 5/420 |
| 5,103,514 | A | * | 4/1992 | Leach | 5/655 |
| 5,165,130 | A | * | 11/1992 | Wendling | 5/655 |
| 5,351,348 | A | | 10/1994 | Beger | 5/420 |
| 5,473,785 | A | | 12/1995 | Lager et al. | 5/655 |
| 5,937,465 | A | * | 8/1999 | Carew et al. | 5/655 |
| 5,970,541 | A | | 10/1999 | Chiang | 5/420 |

* cited by examiner

*Primary Examiner*—Michael F. Trettel
(74) *Attorney, Agent, or Firm*—Jo Katherine D'Ambrosio

(57) ABSTRACT

A baby play mat with protective enclosure comprising a mat and one or more bumpers circumscribing the perimeter of the mat. The bumpers comprise fastening means on the top and bottom surfaces. The perimeter of the mat also comprises fastening means. The bumpers are securely and removably attached to the perimeter of the play mat to form a protective tier defining an interior cavity. Additional layers of bumpers can be fastened to the top of the first protective tier to increase the height of the enclosure. Additional mats can be joined together to increase the width of the play area.

15 Claims, 4 Drawing Sheets

BABY PLAY MAT WITH PROTECTIVE ENCLOSURE

FIELD OF THE INVENTION

The present invention relates to a baby play mat with a protective enclosure, particularly to a baby play mat with a protective enclosure comprising one or more bumpers. More particularly, a baby play mat that is expandable and portable.

BACKGROUND

Infants and small children generally require special protection when playing, especially when left alone. Baby playpens and mats have been used to provide an area for an infant or young child to play in moderate safety. These mats are typically portable in order to provide a safe play area for the child while traveling and staying in other places.

Play pens and mats are quite common for use with infants and children. Play mats without side guards are currently available but are not able to restrict the child from leaving the mat. Play pens and mats that have been disclosed are often of fixed size and shape. This type of mat lacks the ability to grow with the needs of the child. Play pens typically have a rigid frame work with mesh sidings that are approximately three feet high. Parents quickly realize that toddlers often object to the "caged-in" atmosphere of these types of enclosures.

Arrangements and devices for protecting infants and small children include a device disclosed in Lager, U.S. Pat. No. 5,600,958. The '958 reference discloses a traveling collapsible toddler bed. The '958 bed relates to a traveling bed arrangement for infants and small children and a method for disassembling a utility bed and pad. The utility bed comprises a rectangular flexible sheet, cushioning members and a pair of end pockets attached at either end of the flexible sheet for receiving the cushioning members. Plastic foam boards are used for the cushioning members and inserted in the pockets, which are folded up and fastened to form a walled bed or play area. The boards are identical to each other. The Lager '785 reference also discloses that the foam boards are rigid, but resilient to yield if a child falls against them. Eves discloses, in U.S. Pat. No. 4,712,258, a baby changing mat. The '258 mat teaches a central padded body with a raised sill extending about a majority of the edge of the mat and is provided with a means for resisting lateral movement by a baby lying on the mat by using a pair of straps. Eves also discloses a mat that has at least one centrally located transverse stabilizing member. Neither the Lager nor Eves patents disclose the ability to change sizes to accommodate a growing child or a parental decision to make a larger area in which to allow the child to play within a safe enclosure.

Beger discloses, in U.S. Pat. No. 5,351,348, a rest pad for an infant. The Beger pad discloses a padded bottom delimited on at least one side by a straight rim section being formed by a filling material which is received in a hollow reception space such that it can be removed for the purpose of lowering the rim section. Beger further teaches that for universal use, the hollow reception space should be defined by a loop connected via a predetermined bending boundary to the bottom. The Beger invention is constructed with fixed size closed loops, therefore, it is not possible to raise the height of its elevated rim without changing the construction of the original pad so it can not be used to safely contain a growing child. Chiang teaches, in U.S. Pat. No. 5,970,541 a modular play mat. The Chiang mat includes a plurality of modules that have cooperating fastening means to permit the modules to be removably connected together in different configurations. Chiang teaches that preferably the fastening means are hook and loop fasteners to connect the modules. Chiang teaches a mat with the ability to change sizes using hook and loop fasteners, but nothing is taught about a rigid wall system to safely contain an infant or child while being able to change shapes with the mat.

Bloom discloses, in U.S. Pat. No. 5,035,013, a foldable infant's play mat with removable side guard. The Bloom mat teaches a portable infant play mat with a cushioned base portion and a cushioned wall portion which follows the perimeter of the base portion. Bloom also teaches that securing means should be provided to removably secure the wall portion to the base portion. The Bloom mat is portable and has a removable securing system for connecting the wall with the mat, but it does not incorporate a rigid wall system. Also, since the Bloom mat is round, it could not be easily expanded to form a larger play area. The Lager '785 reference, the Eves '258 reference and the Beger '348 reference teach portable systems, but do not resolve the problems of safely containing the child within the mat area or expanding as the child grows.

What is needed is a play mat that securely encloses a child and is expandable to form a larger play area as the child grows.

SUMMARY

The baby play mat with protective enclosure of the present invention is uniquely assembled to form a safe and sturdy protective play area for an infant or toddler. Advantageously, the baby play can grow with the child. Also, the baby play mat is easily assembled and dissembled so that it is portable.

One preferred embodiment of the baby play mat with protective enclosure comprises a mat having an upper surface, a lower surface and a perimeter. The upper surface of the. mat can comprise fastening means, VELCRO® type hook and loop strips for example, adjacent the perimeter. Preferably one or more bumpers circumscribe the perimeter. In one embodiment four bumpers form the enclosure around the mat. Preferably, the bumpers are of uniform size for ease of assembly. The bumpers comprise a top surface and a bottom surface, the top surface comprising a top fastening means and the bottom surface comprising a bottom fastening means. The bumpers can be removable attached to the mat by connecting the fastening means of the play mat to the bottom fastening means of the bumper to form a protective tier circumscribing the perimeter. The protective tier defines an interior cavity or play area above the upper surface of the mat.

One or more additional bumpers comprising a second bottom fastening means or, alternatively, a second top fastening means and a second bottom fastening means, can be fixedly layered upon the protective tier to form a second protective tier. Alternatively, the baby play mat can comprise two or more additional protective tiers fixedly layered on the perimeter of the mat.

The baby play mat can comprise two or more bumpers wherein each bumper comprises an outer surface, an inner surface, a first end, a second end, a first fastening means positioned on the outer surface adjacent the first end and a second fastening means positioned on the outer surface adjacent the second end. The first fastening means of one bumper is removeably attached to the second fastening means of another bumper until all bumpers are securely fastened together to form a secure, protective tier.

One embodiment of the method of assembling this invention includes the step of color coding the perimeter of the play mat and the bumpers so that a bottom of each bumper is the same color as one of the sides of the perimeter. Alternatively, the perimeter of the play mat can be foot printed to the size and shape of the bumpers so that each bumper is placed within the matching, color coded footprint.

Additional bumpers can be fastened to each other to form a second protective tier upon the top of the first protective tier to increase the height of the enclosed area. Alternatively, a preferred baby play mat with protective enclosure can comprise at least two or more mats fastened to each other by fastening means, tabs and loops, for example, with six to eight bumpers fastened to the outer perimeters of the joined mats to increase the width and length of the play area.

DETAILED DESCRIPTION OF THE PREFERRED EMBODIMENTS

Figure 1:
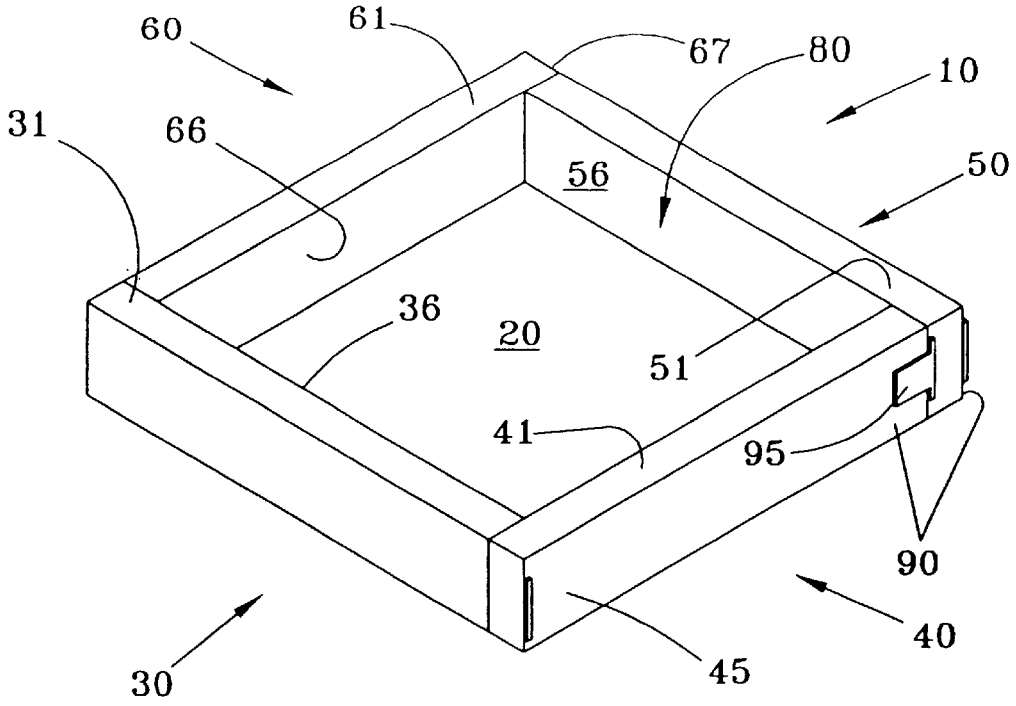
FIG. 1 is a perspective view of one preferred embodiment.
Figures 2, 2A:
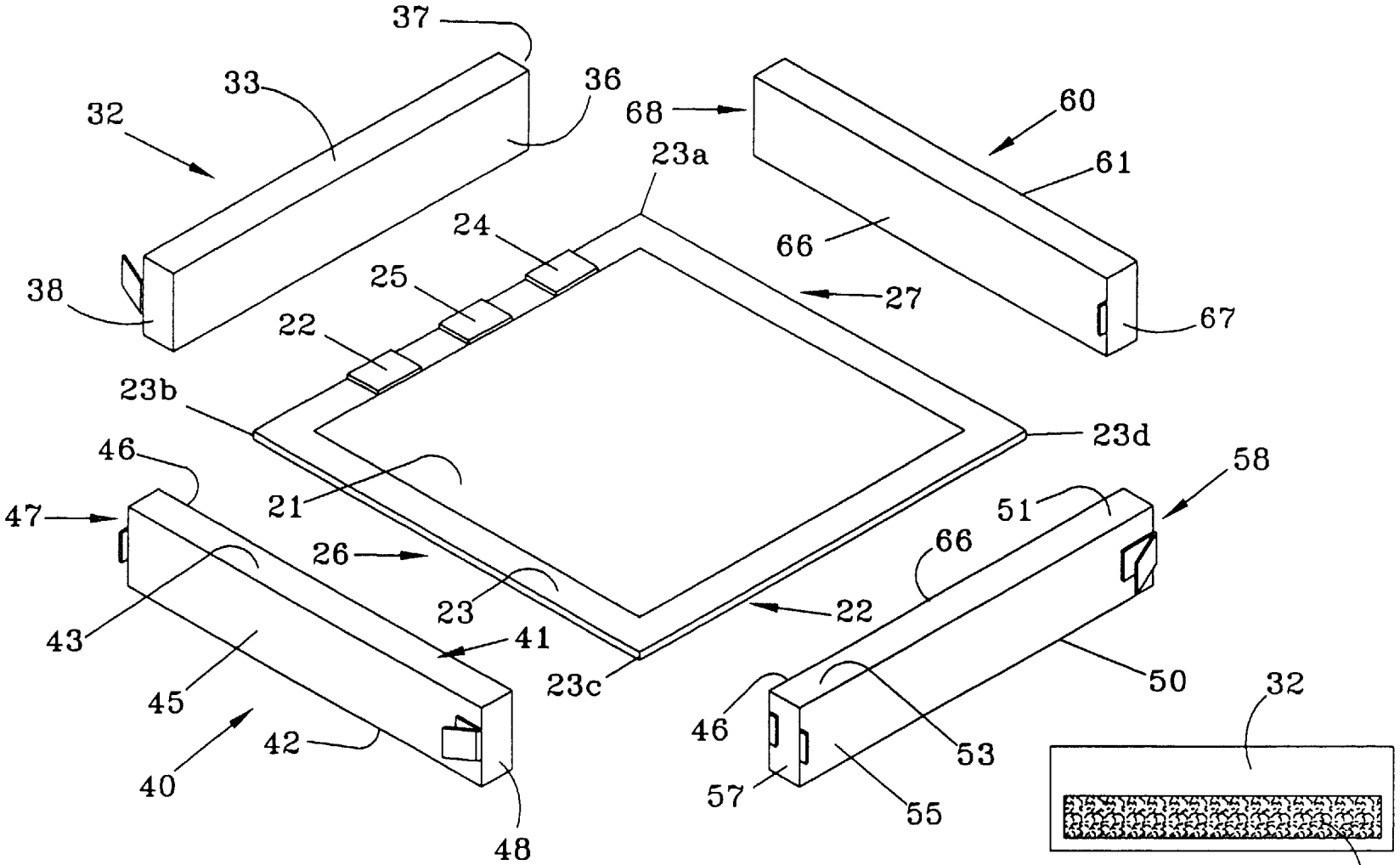
FIG. 2 is an exploded view of FIG. 1.
FIG. 2*a* is a section of the bumper illustrating a bottom fastening means.
Figure 6:
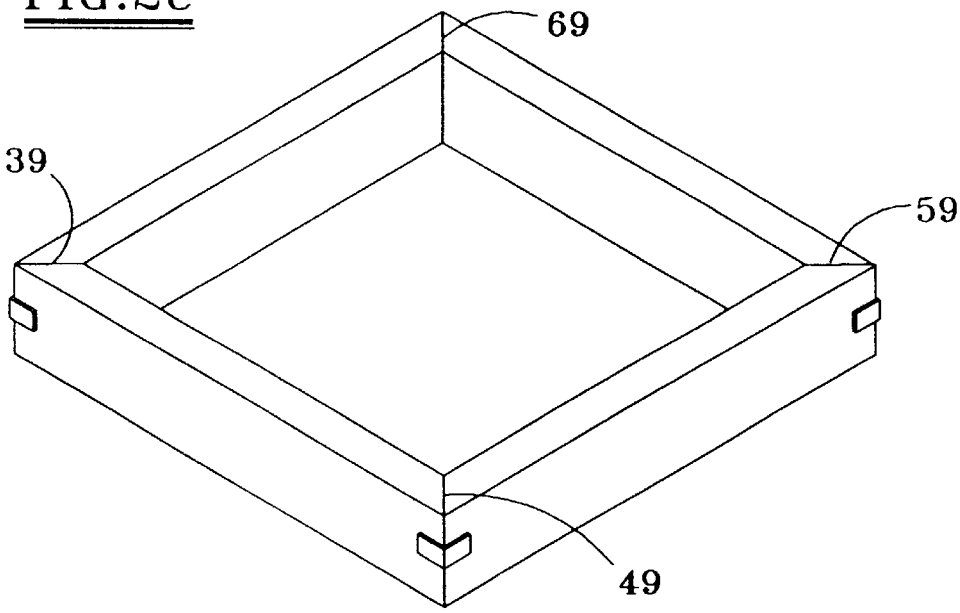
FIG. 6 is perspective view of another embodiment of the baby play mat with angled corners.
Figure 4:
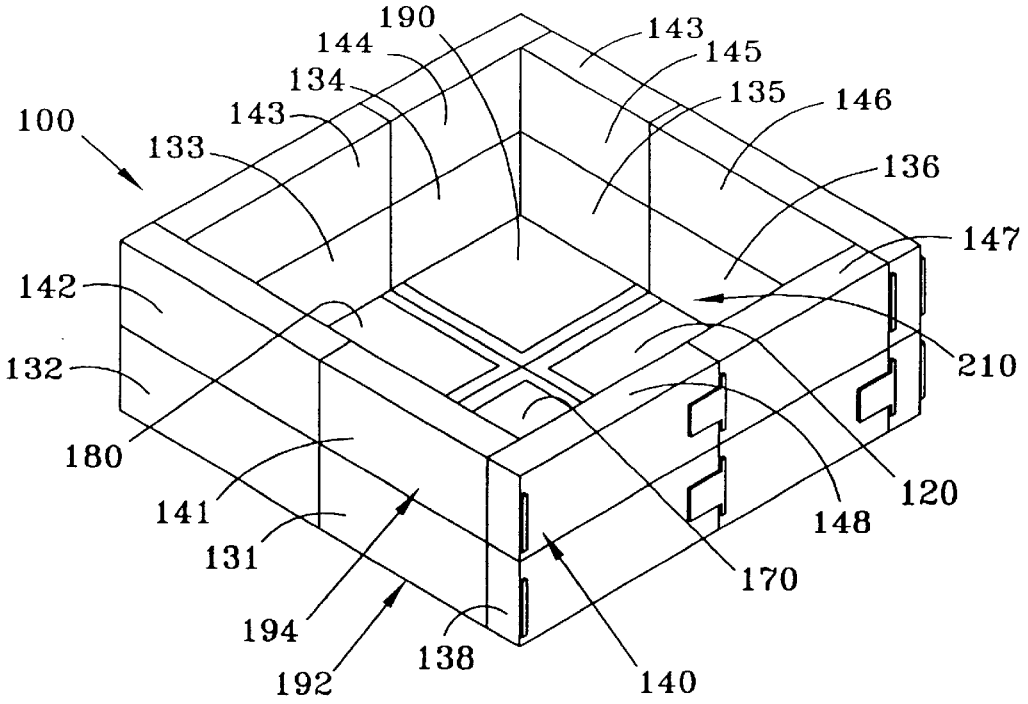
FIG. 4 is a view of an expanded embodiment of the invention.

Reference will now be made in detail to the present preferred embodiment of the invention as depicted in the accompanying drawings. As illustrated in FIGS. 1 and 2, one preferred embodiment of the baby play mat with protective enclosure 10 comprises a mat 20 with four attached bumpers 30, 40, 50, 60 encompassing its perimeter 23 to form a protective tier 90 for enclosing a child. Alternatively, one continuous bumper 230 can be used to form the enclosure 225 as illustrated in FIG. 6. Preferably, the height of the protective tier 90 is within a range of 3 inches to 10 inches so that an infant or small child can not crawl or roll over it but the tier 90 is not so high as to block the child's vision. As the child grows and becomes more active, a second and third protective tier of bumpers can be added, as shown in FIG. 4, 190.

The mat 20 is preferably made of a soft quilted material to provide a comfortable padding for the child. Any material that is child-safe, durable, stain resistant and washable or wipeable could be used for the mat 20 as well as the exterior of the bumpers 30, 40, 50, 60. Cotton, plastic, vinyl or nylon cloth materials are typical. In one preferred embodiment, the cloth fabric used to cover the exterior of the bumpers 30, 40, 50, 60 is a VELCLOTH® hook and loop type fabric. VELCLOTH® type fabric is manufactured to securely fasten to a hook and loop fastener sold under the trademark, VELCRO®. In this embodiment, the entire surface of the VELCLOTH® type fabric will fixedly attach to corresponding VELCRO® hook or loop fasteners. Toys or other child-oriented attachments with hook and loop type fasteners can adhere to the VELCLOTH® type fabric so that they are removably attachable to the bumpers 30, 40, 50, 60.

Because the bumpers 30, 40, 50, 60, must withstand a child's attempts to climb on or pull up on them, the bumpers 30, 40, 50, 60 must have a firm and durable interior. Firm foam rubber for example, is preferred because it is resilient and complies with known safety standards for infants and toddlers. It is important that the bumpers 30, 40, 50, 60 are made out of a material that is firm enough so that it does not conform to a baby's face nor indent easily to allow the child to crawl or fall over it. Also, the baby play mat with enclosures 10 should not have any hard surfaces or small parts that could possibly cause injury.

As illustrated in FIG. 2, one embodiment of the invention 10 comprises a mat 20 and bumpers 30, 40, 50, 60, that are easily assemble and disassembled so that the baby play mat with enclosures 10 is portable. Preferably, the bumpers 30, 40, 50, 60, are removably attached to the play mat 20 and to each other. The bumpers can be of uniform size for ease of assembly and portability. In one embodiment, the bottom surface 22 of the mat 20 comprises ties or fasteners and a handle so that the bumpers 30, 40, 50, 60, can be rolled within the mat 20 and tied. In this way, the baby play mat with protective enclosures 10 is easily transportable.

The unique assembly of the baby play mat with enclosures 10 is an important aspect of child safety. The bumpers 30, 40, 50, 60 are securely fastened to each other and the mat 20 so that the child cannot slip underneath or between the bumpers 30, 40, 50, 60. To accomplish this, the mat 20 is comprised of a perimeter 23, an upper surface 21 and a lower surface 22. Preferably, the mat comprises fastening means 24, VELCRO® hook and loop fasteners for example, on its upper surface 21 positioned adjacent the perimeter 23. Alternatively, the upper surface 21 of the mat positioned adjacent the perimeter 23 comprises VELCLOTH® hook or loop type fabric. Each bumper 30, 40, 50, 60 has a bottom surface 32, 42, 52, 62, and a top surface 31, 41, 51, 61. As seen in FIG. 2 and FIG. 2A, the bottom surfaces, or, in alternative embodiments, both the bottom surface 32, 42, 52, 62, and the top surface 31, 41, 51, 61 for multiple tiers, can comprise fastening means 24 to fasten the bottom surfaces 32, 42, 52, 62 of the bumpers 30, 40, 50, 60 to the upper surface 21 of the perimeter 23.

In one preferred embodiment as illustrated in FIG. 2, the fastening means is VELCRO®. Strips of VELCRO®. like material are secured to the perimeter 23 of the mat and the bottom surfaces 32, 42, 52, 62 of the bumpers 30, 40, 50, 60. Alternatively, the upper surface 21 of the mat positioned adjacent the perimeter 23 comprises VELCLOTH® hook or loop type fabric so that the bottom surfaces are removably attached to the VELCLOTH® hook or loop type fabric of the mat 20. Other fastening means, snaps, adhesives, zippers, for. example, are within the scope of this invention n. By having the fastening means both on the bottom surface 32, 42, 52, 62, and the top surface 31, 41, 51, 61 of the bumpers 30, 40, 50, 60, additional layers of bumpers or protective tiers 90 can be added as the child grows. In an embodiment comprising VELCLOTH® hook or loop type fabric on the exterior surfaces of the bumpers 30, 40, 50, 60, strips of VELCRO®. like material need only be secured to the bottom surfaces 32, 42, 52, 62 of the bumpers 30, 40, 50, 60 to form additional layers of protective tiers 90.

The positioning of the bumpers 30, 40, 50, 60 along the perimeter 23 is an innovative feature of this invention. Secure positioning contributes to the safety and strength of the baby play mat 10. The bumpers 30, 40, 50, 60 form a protective tier 90 to enclose the child. It is important that the protective tier 90 be secure and stable so that the bumpers 30, 40, 50, 60 do not give way or fall apart when a child attempts to climb on it or crawl over it. The bumpers 30, 40, 50, 60 are securely fastened to the perimeter 23. One novel aspect of this invention 10 is that the way the ends of the bumpers are aligned and connected to one another. The alignment of the bumpers provides great strength to the resulting protective tier 90, and also allows for easy assembly on the mat 20 using the fastening means provided.

FIGS. 1 and 2 depicts this aspect of assembly of mat 20 and bumpers 30, 40, 50, 60 and their relationship and orientation relative to each other. Both FIGS. 1 and 2 illustrates the importance of the alignment of the bumpers 30, 40, 50, 60 and how they abut each other to form a strong enclosure. A preferred baby play mat with protective enclosure 10 comprises a mat 20 having a perimeter 23 with four sides 25, 26, 27, 28, a first side 25, a second side 26, a third side 27 and a fourth side 28, and four corners 23*a*, 23*b* 23*c*, 23*d*. Four bumpers form a protective tier 90 around the perimeter 23. The first bumper 30 is positioned along the first side 25 of the perimeter. The first bumper 30 preferably comprises a first inner surface 36, a first outer surface 35, a first end 37 and a second end 38. The first end 37 of the first bumper 30 is immediately adjacent to a first corner 23*a* of the perimeter 23. The second bumper 40 is positioned on the second side 26 of the perimeter 23, the second bumper 40 comprising a second inner surface 46, a second outer surface 45, a third end 47 and a fourth end 48. The third end is positioned at a second corner 23*b* of the perimeter 23 so that the first end 37 of the first bumper 30 abuts the second inner surface 46 adjacent the third end 47.

The third bumper 50 is positioned on the third side 27 of the perimeter 23, the third bumper 50 comprising a third inner surface 56, a third outer surface 55, a fifth end 57 and a sixth end 58. The fifth end 57 of the bumper 50 is positioned at a third corner 23*c* of the perimeter 23. The fourth end 48 of the second bumper 40 abuts the third inner surface 56 adjacent the fifth end 57. A fourth bumper 60 is positioned on the fourth side 28 of the perimeter 23. The fourth bumper 60 comprises a fourth inner surface 66, a fourth outer surface 65, a seventh end 67 and an eighth end 68. The seventh end 67 is positioned at a fourth corner 23*d* of the perimeter 23 and the sixth end 58 of the third bumper 50 abuts the fourth inner surface 66 adjacent the seventh end 67. The eighth end 68 of the fourth bumper 60 abuts the first inner surface 36 adjacent the second end 38 of the first bumper 30 so that the four bumpers 30, 40, 50, 60 form a first protective tier 90 defining an inner cavity 21 or play area above the mat 20.

Figure 3:
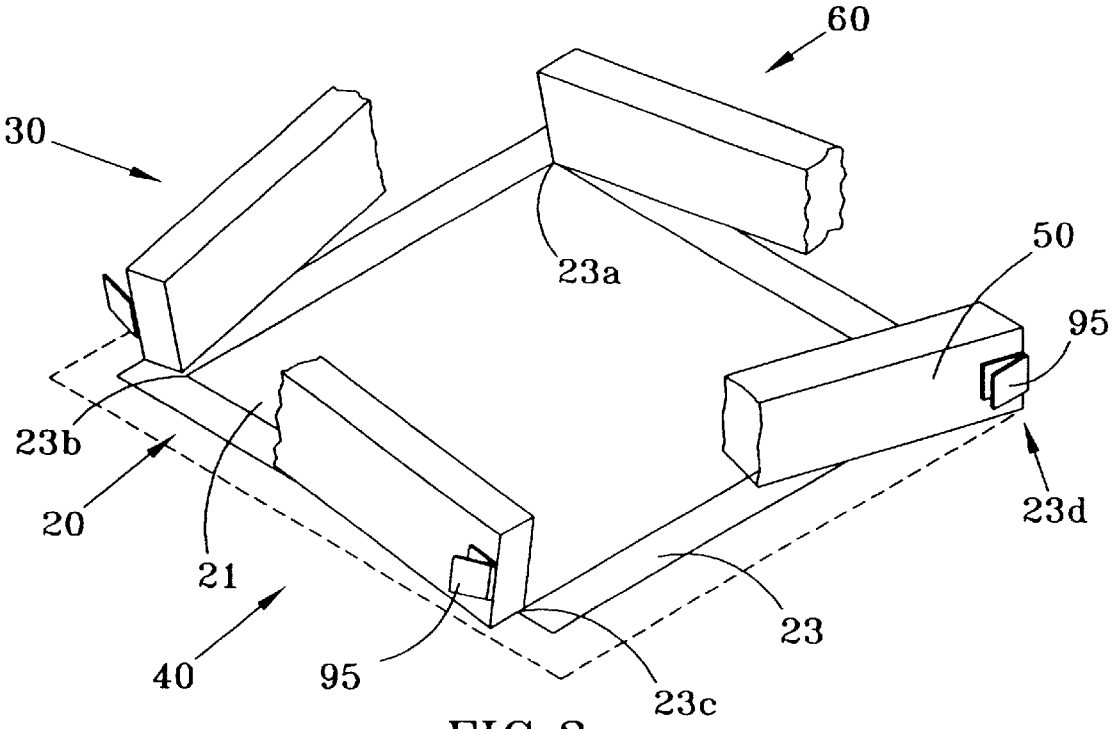
FIG. 3 is an exploded view of FIG. 1 illustrating attachment of bumpers.
Figure 2B:
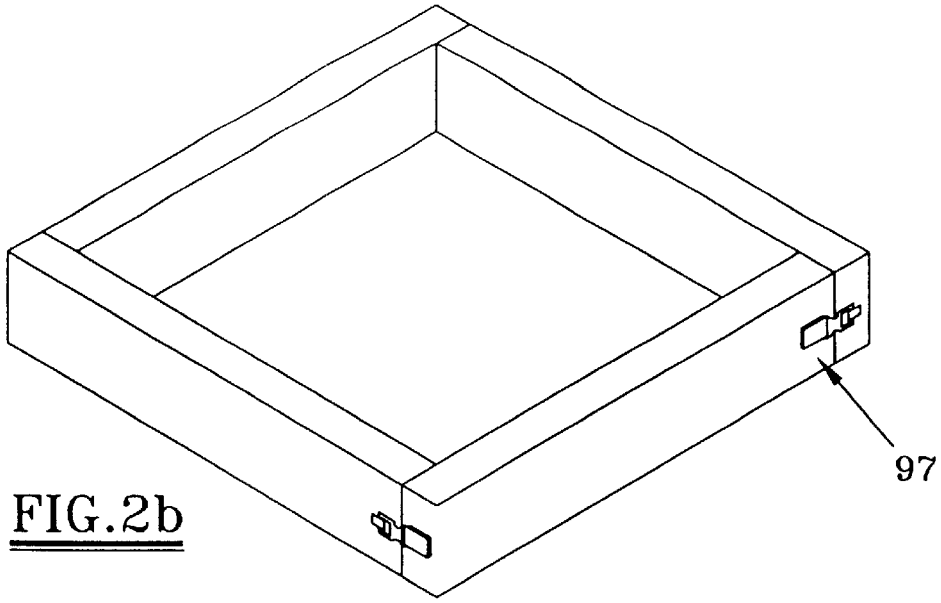
FIG. 2*b* and FIG. 2*c* illustrate a snap fastening means of attaching bumpers.
Figure 2C:
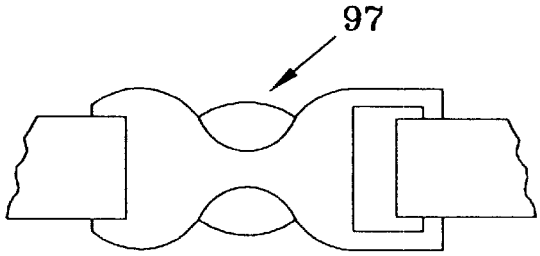

In one embodiment, the bumpers 30, 40, 50, 60 are attached and securely fastened to each other by a tab 95 and loop 98 arrangement, FIGS. 2, 3 and 4. The tab 95 and loop 98 arrangement can be positioned on the outer surfaces of the bumpers, 35, 45, 55, 65. Preferably, the tab 95 is comprised of VELCRO® type material. The tab 95 is pulled through the loop 98 and folded back on itself so that it securely holds one bumper 30 to another 40. Another preferred method of securely attaching the bumpers 30, 40, 50, 60 to each other is a snap buckle fastener 97 as illustrated in FIGS. 2*b* and 2*c*. The ends of the bumpers 30, 40, 50, 60 are fitted with snap buckles 97 such as the types of snap buckles that are commonly used to secure infants and children in car seats or high chairs. Other methods of attaching the bumpers 30, 40, 50, 60 to form a secure protective tier 90 are within the scope of this invention as long as the method used securely fasten the bumpers 30, 40, 50, 60 to each other. In another preferred embodiment, the ends of each bumper 30, 40, 50, 60 are fitted with VELCRO® like strips at the point of attachment so that the bumpers 30, 40, 50, 60 securely adhere to each when positioned on the mat 20. Other methods of attachment include, for example, a strap and a buckle system; or tabs or ribbons that tie together.

In one preferred embodiment, the ends of the bumpers 30, 40, 50, 60 for a right angle so that the bumpers 30, 40, 50, 60 comprise a rectangular shape. When the bumpers 30, 40, 50, 60 are fastened, they are closely adjacent each other. In this way, a child cannot easily push an arm or leg underneath or between the bumpers 30, 40, 50, 60. Alternatively, as shown in FIG. 6, the ends of the bumpers 30, 40, 50, 60 are angled at reciprocal angles so that they closely fit together to form a smooth, tight corner 39, 49, 59, 69, commonly known as "picture frame corners."

A preferred method for assembling a baby play mat with protective enclosure 10 comprises placing a mat 20 having a perimeter 23 with four sides 25, 26 a first side 25, a second side 26, a third side 27, and a fourth side 28 on a rigid surface, a floor, preferably carpeted. The upper surface 21 of the perimeter 23 and bottom surfaces 32, 42, 52, 62 of the bumpers 30, 40, 50, 60 can comprise fastening material such as VELCRO® strips 24, 33, 43, 53, 63 to firmly adhere to each other as describe above. In this way, a first bumper 30 is fastened to a first side 25 of the upper surface 21 of the perimeter 23. The bumper 30, comprising a first inner surface 36, a first outer surface 35, a first end 37 and a second end 38, is aligned by placing it onto the first side 25 of the mat so the first end 37 of the first bumper 30 is immediately adjacent to an end of the first side 25 of the perimeter 23 at corner 23*a*.

A second bumper 40, comprising a second inner surface 46, a second outer. surface 45, a third end 47 and a fourth end 48 is aligned on the mat 23 by placing it onto the second side 26 so that the first end 37 of the first bumper abuts the second inner surface 46 adjacent the third end 47 of the second bumper 40. Preferably, the first bumper 30 and the second bumper 40 are to be connected by placing the tab 95 on the second end 38 of the first bumper 30, inside and around the loop 98 on the first end 47 of the second bumper 40 to firmly secure them together.

A third bumper 50, comprising a third inner surface 56, a third outer surface 55, a fifth end 57 and a sixth end 58 is placed onto the third side 27 of the mat 23 so the fourth end 48 of the second bumper 40 abuts the third inner surface 56 adjacent the fifth end of the third bumper 57. A fourth bumper 60, comprising a fourth inner surface 66, a fourth outer surface 65 a seventh end 67 and an eighth end. 68 is aligned on the mat 23 by placing it onto the fourth side 28 of the mat 23 so the sixth end 58 of the third bumper 50 abuts the fourth inner surface 66 adjacent the seventh end 67 and the eight end 68 of the fourth bumper 60 abuts the first inner surface 36 adjacent the second end 38 of the first bumper so that, when all the bumpers 30, 40, 50, 60 are hooked and secured to each other, a first protective tier 90 is formed.

An alternative preferred method of aligning the bumpers 30, 40, 50, 60 on the mat 20 comprises the additional step of color coding the perimeter 23 of the mat and the bumpers 30, 40, 50, 60 so that a bottom of each bumper is the same color as one of the sides 25, 26, 27, 28 of the perimeter 23. In this method, the first end 37 of the first bumper 30 is placed on the mat 20 on top of its corresponding color. Preferably, the bumpers are of uniform size for ease of assembly. The color coded region on the play mat 20 will be aligned with the second end 38 of the first bumper 30 with the corner 23*a* of the play mat 20. The first end 37 of the first bumper 30 will reside in the color coded region that is drawn to end against the color coded region for bumper four 60. The result of the color-coded assembly is the same as described above for FIGS. 1 and 2. The use of colors makes it easier to assemble the baby play mat with protective enclosure 10.

Alternatively, the method of assembling the baby play mat 10 further comprises the step of foot printing the perimeter of the mat to the size and shape of the bumpers so that each bumper is placed within the matching footprint. The foot prints can be color coded for ease of alignment.

This method further includes the steps of forming additional protective tiers 192, 194 to increase the height of the protective enclosure when needed as the child grows. As depicted in FIG. 4, additional tiers 192, 194 can be added by adding additional layers of bumpers.

Figure 5:
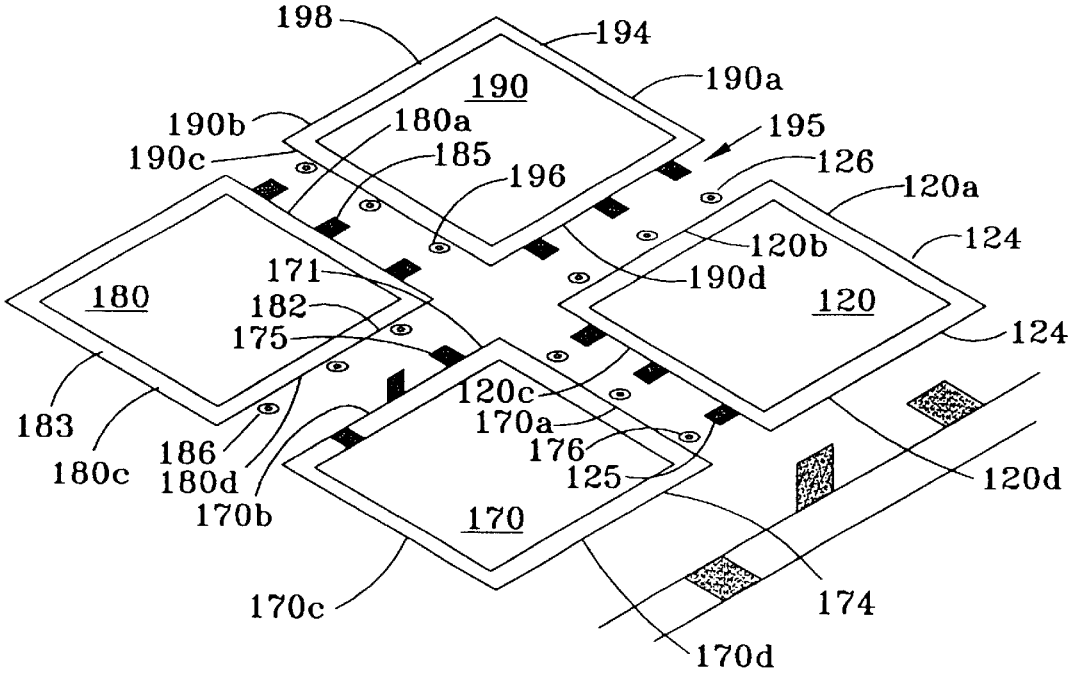
FIG. 5 is a plane view illustrating the assembly of multiple mats.

In another preferred embodiment, the width, length and height of the baby play mat 10 can be increased to accommodate the growing child. In this embodiment additional mats and bumpers are securely fastened to form larger play areas. FIGS. 4 and 5 illustrate the baby play mat with protective enclosure 10 comprising at least two mats 120, 170, as shown, four mats 120, 170, 180, 190. Additional mats can be added depending on the desired size. Each mat 120, 170, 180 190 has a perimeter comprising four sides 120*a, b, c, d*, 170, *a, b, c, d*, 180, *a, b, c, d*, 190, *a, b, c, d*. One side of each perimeter is fastenly affixed to a side of another perimeter so that one large play area is formed. At least four bumpers 131, 132, 133,134 are fastened to the outer perimeters of the mats to form a large protective enclosure 210. The number of bumpers 131, 132, 133, 134 used to form the protective tier 192 is a factor of 1) the size of the resulting mat area when two or more mats are joined together and 2) the length of the individual bumpers 131, 132, 133, 134.

FIG. 4 illustrates one embodiment, for example, with four mats joined together and eight bumpers 131, 132, 133, 134, 135, 136, 137, 138 fastenly affixed to each other to form a first protective tier 192 above the mats. In this drawing, eight additional bumpers are fastenly affixed to each other to form a second protective tier 194 positioned upon the top of the first protective tier 192. The means and method of fastening and securing the bumpers to the mats and the bumpers to each other is described above.

FIG. 5 illustrates one preferred means of fastening four mats 120, 170, 180, 190 together. Each mat 120, 170, 180, 190 has loops 126, 176, 186, 196 on one side of the mat to engage with tabs 125, 175, 185, 195 on another side so that the mats 120, 270, 180, 190 are securely joined to each other. Preferably, the tabs 125, 175, 185, 195 comprise VELCRO®D type material and are pulled through the loops 126, 176, 186, 196 and fastened so that all mats are connected to make a four play mat configuration. Other fastening methods to join the mats are within the scope of this invention.

Alternative embodiments of the baby play mat with protective enclosure are apparent. For example, the upper surface 21 of the mat and the insides of the bumper can be decorated with educational forms, designs and games for the child. Toys can be removably fastened to the top of the bumpers 30, 40, 50, 60.

The foregoing description is illustrative and explanatory of preferred embodiments of the invention, and variations in the size, shape, materials and other details will become apparent to those skilled in the art. It is intended that all such variations and modifications which fall within the scope or spirit of the appended claims be embraced thereby.

What is claimed is:

1. A baby play mat with a protective enclosure comprising:

a mat having an upper surface, a lower surface and a perimeter, the upper surface of the mat comprising fastening means adjacent the perimeter;

one or more bumpers circumscribing the perimeter, the bumpers comprising a top surface and a bottom surface, the top surface comprising a top fastening means and the bottom surface comprising a bottom fastening means, the bumpers fixedly attached to the mat by connecting the fastening means of the mat to the bottom fastening means of the bumper to form a protective tier circumscribing the perimeter, the protective tier defining an interior cavity above the upper surface of the mat, one or more additional bumpers comprising a second top fastening means and a second bottom fastening means, are fixedly layered upon the protective tier to form a second protective tier.

2. A baby play mat with a protective enclosure comprising:

a mat having an upper surface, a lower surface and a perimeter, the upper surface of the mat comprising fastening means adjacent the perimeter;

two or more bumpers circumscribing the perimeter, the bumpers comprising a top surface and a bottom surface, the top surface comprising a top fastening means and the bottom surface comprising a bottom fastening means, the bumpers fixedly attached to the mat by connecting the fastening means of the mat to the bottom fastening means of the bumper to form a protective tier circumscribing the perimeter, the protective tier defining an interior cavity above the upper surface of the mat;

wherein each bumper comprises an outer surface, an inner surface, a first end, a second end, a first fastening means positioned on the outer surface adjacent the first end and a second fastening means positioned on the outer surface adjacent the second end so that attaching the first fastening means of one bumper to the second fastening means of another bumper until all bumpers are securely fastened together to form a secure, protective tier.

3. A baby play mat with a protective enclosure comprising:

A mat having an upper surface, a lower surface and a perimeter, the upper surface of the mat comprising fastening means adjacent the perimeter; one or more bumpers circumscribing the perimeter, the bumpers comprising a top surface and a bottom surface, the top surface comprising a top fastening means and the bottom surface comprising a bottom fastening means, the bumpers fixedly attached to the mat by connecting the fastening means of the mat to the bottom fastening means of the bumper to form a protective tier circumscribing the perimeter, the protective tier defining an interior cavity above the upper surface of the mat;

the fastening means comprise a snap buckle.

4. A baby play mat with a protective enclosure comprising:

A mat having an upper surface, a lower surface and a perimeter, the upper surface of the mat comprising fastening means adjacent the perimeter; one or more bumpers circumscribing the perimeter, the bumpers comprising a top surface and a bottom surface, the top surface comprising a top fastening means and the bottom surface comprising a bottom fastening means, the bumpers fixedly attached to the mat by connecting the fastening means of the mat to the bottom fastening means of the bumper to form a protective tier circumscribing the perimeter, the protective tier defining an interior cavity above the upper surface of the mat;

the ends of each bumper are angled to form a close fit when the bumpers are fastened closely adjacent to each other.

5. A baby play mat with a protective enclosure comprising:

a baby mat having a perimeter, the perimeter comprising a first side, a second side, a third side and a fourth side and four corners, the perimeter further comprising fastening material; and four bumpers, the four bumpers comprising:

a first bumper positioned along the first side of the perimeter, the first bumper comprising a first inner surface, a first outer surface, a first end and a second end, the first bumper immediately adjacent to a first corner of the perimeter;

a second bumper positioned on the second side of the perimeter, the second bumper comprising a second inner surface, a second outer surface, a third end and a fourth end, the third end positioned at a second corner of the perimeter, the first end of the first bumper abutting the second inner surface adjacent the third end;

a third bumper positioned on the third side of the perimeter, the third bumper comprising a third inner surface, a third outer surface, a fifth end and a sixth end, the fifth end of the bumper positioned at a third corner of the perimeter, the fourth end of the second bumper abutting the third inner surface adjacent the fifth end;

a fourth bumper positioned on the fourth side of the perimeter, the fourth bumper comprising a fourth inner surface, a fourth outer surface, a seventh end and an eighth end, the seventh end positioned at a fourth corner of the perimeter, the sixth end of the third bumper abutting the fourth inner surface adjacent the seventh end and the eighth end of the fourth bumper abutting the first inner surface adjacent the second end of the first bumper so that the four bumpers form a first protective tier, the protective tier forming an inner cavity.

6. The baby play mat of claim 5 wherein the protective tier is securely and removeably attached to the perimeter.

7. The baby play mat of claim 5 wherein a second protective tier is fastened to a top of the first protective tier.

8. The baby play mat of claim 5 wherein each bumper is securely and removeably attached to another bumper.

9. A method for assembling a baby play mat with a protective enclosure comprising:

a. placing a mat having a perimeter with four sides, a first side, a second side a third side and a fourth side on a rigid surface, the perimeter comprising fastening material,;

b. fastening a first bumper, comprising a first inner surface, a first outer surface, a first end and a second end to the first side of the mat so the first end of the first bumper is immediately adjacent to an end of the first side of the perimeter;

c. fastening a second bumper, comprising a second inner surface, a second outer surface, a third end and a fourth end to the second side of the mat so the first end of the first bumper abuts the second inner surface adjacent the third end of the second bumper;

d. fastening a third bumper, comprising a third inner surface, a third outer surface, a fifth end and a sixth end to the third side of the mat so the fourth end of the second bumper abuts the third inner surface adjacent the fifth end of the third bumper;

e. fastening a fourth bumper, comprising a fourth inner surface, a fourth outer surface, a seventh end and an eighth end to the fourth side of the mat so the sixth end of the third bumper abuts the fourth inner surface adjacent the seventh end and the eight end of the fourth bumper abuts the first inner surface adjacent the second end of the first bumper so that a first protective tier of bumpers is formed.

10. The method of claim 9 further comprising the step of color coding the perimeter of the mat and the bumpers so that a bottom of each bumper is the same color as one of the sides of the perimeter.

11. The method of claim 9 further comprising the step of foot printing the perimeter of the mat, the foot print comprising color coded regions matching the size and shape of the bumpers so that each bumper is placed within the matching, color coded footprint.

12. The method of claim 9 further comprising the steps of fastening four additional bumpers to each other to form a second protective tier and placing the second protective tier upon the top of the first protective tier.

13. The method of claim 9 further comprising the step of forming additional protective tiers to increase the height of the protective enclosure.

14. A baby play mat with protective enclosure comprising:

at least two mats, each mat having a perimeter, each perimeter comprising four sides, one side of each perimeter fastenly affixed to a side of another perimeter;

at least four bumpers fastened to the perimeters of the mats to form a protective enclosure.

15. The method of claim 14 further comprising six bumpers affixed to each other to form a first protective tier above the mats.

* * * * *